US010390675B2

(12) United States Patent
Anim-Mensah et al.

(10) Patent No.: US 10,390,675 B2
(45) Date of Patent: Aug. 27, 2019

(54) WAREWASH MACHINE CLEANING NOTIFICATION AND IN-SITU DILUTION PROCESS

(71) Applicant: ILLINOIS TOOL WORKS INC., Glenview, IL (US)

(72) Inventors: Alexander R. Anim-Mensah, Centerville, OH (US); Shawn D. Waterman, Troy, OH (US); Nicholas T. Weiss, Huber Heights, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 445 days.

(21) Appl. No.: 15/091,900

(22) Filed: Apr. 6, 2016

(65) Prior Publication Data

US 2016/0345797 A1 Dec. 1, 2016

Related U.S. Application Data

(60) Provisional application No. 62/169,140, filed on Jun. 1, 2015.

(51) Int. Cl.

| | |
|---|---|
| ***A47L 15/00*** | (2006.01) |
| ***A47L 15/42*** | (2006.01) |
| ***A47L 15/24*** | (2006.01) |

(52) U.S. Cl.

CPC ..... *A47L 15/0047* (2013.01); *A47L 15/0023* (2013.01); *A47L 15/0031* (2013.01);
(Continued)

(58) Field of Classification Search

CPC ..... A47L 15/0023; A47L 15/0031; A47L 15/0047; A47L 15/0057; A47L 15/0078;
(Continued)

(56) References Cited

U.S. PATENT DOCUMENTS

| | | | |
|---|---|---|---|
| 1,585,392 | A | 5/1926 | Lathrop |
| 1,730,348 | A | 10/1929 | Anstiss |

(Continued)

FOREIGN PATENT DOCUMENTS

| | | |
|---|---|---|
| DE | 1428349 | 11/1968 |
| DE | 1628813 | 7/1970 |

(Continued)

OTHER PUBLICATIONS

Machine translation of EP1362546A2 dated Nov. 2003 (Year: 2003).*

(Continued)

*Primary Examiner* — Douglas Lee

(74) *Attorney, Agent, or Firm* — Thompson Hine LLP

(57) ABSTRACT

A warewash machine includes in-situ tank soil load reduction that involves at least one of: (i) prior to addition of fresh water, draining the collection tank via a path that exits the collection tank at a location lower than a primary overflow path until wash liquid level in the collection tank drops below a standard operating level, and thereafter adding fresh water; or (ii) draining the collection tank via a path that exits the collection tank at a location lower than a primary overflow path while simultaneously adding fresh water; or (iii) adding fresh water such that wash liquid level in the collection tank rises above a standard operating level, and thereafter carrying out draining of the collection tank.

7 Claims, 2 Drawing Sheets

(52) U.S. Cl.
CPC ..... *A47L 15/0057* (2013.01); *A47L 15/0078* (2013.01); *A47L 15/241* (2013.01); *A47L 15/4223* (2013.01); *A47L 15/4244* (2013.01); *A47L 2401/06* (2013.01); *A47L 2401/09* (2013.01); *A47L 2401/10* (2013.01); *A47L 2401/12* (2013.01); *A47L 2401/20* (2013.01); *A47L 2401/22* (2013.01); *A47L 2401/32* (2013.01); *A47L 2501/01* (2013.01); *A47L 2501/02* (2013.01); *A47L 2501/26* (2013.01); *A47L 2501/34* (2013.01)

(58) Field of Classification Search
CPC ..... A47L 15/241; A47L 15/4223; A47L 15/4244; A47L 2401/06; A47L 2401/09; A47L 2401/10; A47L 2401/12; A47L 2401/20; A47L 2401/22; A47L 2401/32; A47L 2501/01; A47L 2501/02; A47L 2501/26; A47L 2501/34
See application file for complete search history.

(56) References Cited

U.S. PATENT DOCUMENTS

| | | | |
|---|---|---|---|
| 2,235,885 | A | 3/1941 | Johnson |
| 2,270,595 | A | 1/1942 | Lewis |
| 3,384,097 | A | 5/1968 | Meeker et al. |
| 3,504,390 | A | 4/1970 | Wing |
| 3,598,131 | A | 8/1971 | Weihe, Jr. |
| 3,739,790 | A | 6/1973 | Gudz et al. |
| 3,789,860 | A | 2/1974 | Katterheinrich et al. |
| 3,900,040 | A | 8/1975 | Graber et al. |
| 4,066,472 | A | 1/1978 | Perry et al. |
| 4,070,204 | A | 1/1978 | Hardy et al. |
| 4,231,806 | A | 11/1980 | Henry |
| 4,313,451 | A | 2/1982 | Vilen |
| 4,366,005 | A | 12/1982 | Oguri et al. |
| 4,509,543 | A | 4/1985 | Livingston et al. |
| 4,532,983 | A | 8/1985 | Bradshaw et al. |
| 4,561,904 | A | 12/1985 | Eberhardt et al. |
| 4,788,992 | A | 12/1988 | Swainbank et al. |
| 5,048,139 | A | 9/1991 | Matsumi et al. |
| 5,134,867 | A | 8/1992 | Kiuchi et al. |
| 5,438,507 | A | 8/1995 | Kim et al. |
| 5,470,142 | A | 11/1995 | Sargeant et al. |
| 5,497,798 | A | 3/1996 | Fritz et al. |
| 5,560,060 | A | 10/1996 | Dausch et al. |
| 5,586,567 | A | 12/1996 | Smith et al. |
| 5,596,408 | A | 1/1997 | Cummins et al. |
| RE35,566 | E | 7/1997 | Boyer et al. |
| 5,729,025 | A | 3/1998 | Erickson et al. |
| 5,731,868 | A | 3/1998 | Okey et al. |
| 5,792,276 | A | 8/1998 | Driessen |
| 5,800,628 | A | 9/1998 | Erickson et al. |
| 5,803,985 | A | 9/1998 | Alvord |
| 5,846,339 | A | 12/1998 | Masshoff et al. |
| 5,889,192 | A | 3/1999 | Engel |
| 5,923,432 | A | 7/1999 | Kral |
| 5,957,144 | A | 9/1999 | Neff et al. |
| 6,007,640 | A | 12/1999 | Neff et al. |
| 6,035,471 | A | 3/2000 | Lahrmann et al. |
| 6,354,481 | B1 | 3/2002 | Rich et al. |
| 6,432,216 | B1 | 8/2002 | Thies |
| 6,464,798 | B1 | 10/2002 | Rosenbauer et al. |
| 6,509,558 | B1 | 1/2003 | Loch et al. |
| 6,544,344 | B2 | 4/2003 | Hegeman et al. |
| 6,632,291 | B2 | 10/2003 | Rabon et al. |
| 6,771,373 | B2 | 8/2004 | Schenkl et al. |
| 6,924,499 | B2 | 8/2005 | Poisel et al. |
| 7,082,959 | B1 | 8/2006 | Franklin |
| 7,086,406 | B2 | 8/2006 | Jung et al. |
| 7,162,896 | B2 | 1/2007 | Eiermann et al. |
| 7,241,347 | B2 | 7/2007 | Elick et al. |
| 7,246,396 | B2 | 7/2007 | Czyzewski et al. |
| 7,387,688 | B2 | 6/2008 | Jung et al. |
| 7,392,813 | B2 | 7/2008 | Bertram et al. |
| 7,540,293 | B2 | 6/2009 | Yoon et al. |
| 2002/0096192 | A1 | 7/2002 | Reichold |
| 2003/0196278 | A1 | 10/2003 | Durfee |
| 2004/0182116 | A1 | 9/2004 | Czyzewski et al. |
| 2004/0187898 | A1 | 9/2004 | Chen |
| 2004/0216774 | A1 | 11/2004 | Bertram et al. |
| 2006/0021637 | A1 | 2/2006 | Kang |
| 2006/0054196 | A1 | 3/2006 | Yoon et al. |
| 2007/0272602 | A1 | 11/2007 | Czyzewski et al. |
| 2008/0128000 | A1 | 6/2008 | Kennichi et al. |
| 2008/0128001 | A1 | 6/2008 | Kennichi et al. |
| 2008/0245394 | A1 | 10/2008 | Doherty et al. |
| 2010/0139698 | A1 | 6/2010 | Gnadinger |
| 2012/0298146 | A1* | 11/2012 | Padtberg ..... A47L 15/241 134/25.2 |

FOREIGN PATENT DOCUMENTS

| | | | | |
|---|---|---|---|---|
| DE | 116388 | | 11/1975 | |
| DE | 2607813 | | 9/1977 | |
| DE | 2712020 | | 9/1978 | |
| DE | 2736088 | | 2/1979 | |
| DE | 3419423 | | 11/1984 | |
| DE | 3441222 | | 5/1986 | |
| DE | 3707366 | | 3/1987 | |
| DE | 3922067 | | 1/1991 | |
| DE | 4437737 | | 4/1996 | |
| DE | 29622760 | | 7/1997 | |
| DE | 19644438 | | 4/1998 | |
| DE | 19704989 | | 8/1998 | |
| DE | 19829650 | | 1/2000 | |
| DE | 20220465 | | 8/2003 | |
| DE | 102005030720 | A1 * | 1/2007 | ..... A47L 15/247 |
| EP | 0759721 | | 3/1977 | |
| EP | 0022307 | | 1/1981 | |
| EP | 0678275 | | 10/1995 | |
| EP | 0972486 | | 1/2000 | |
| EP | 0980668 | | 2/2000 | |
| EP | 0980669 | | 2/2000 | |
| EP | 0980670 | | 2/2000 | |
| EP | 1042983 | | 10/2000 | |
| EP | 1362546 | A2 * | 11/2003 | ..... A47L 15/0005 |
| EP | 1481235 | | 12/2004 | |
| EP | 1512363 | | 3/2005 | |
| EP | 2292827 | | 3/2011 | |
| GB | 2243285 | | 10/1991 | |
| JP | 04-327119 | | 11/1992 | |
| JP | 05-269073 | | 10/1993 | |
| JP | 08-056884 | | 3/1996 | |
| JP | 09-0248270 | | 9/1997 | |
| JP | 11-056735 | | 3/1999 | |
| JP | 2001-346747 | | 12/2001 | |
| WO | WO 83/01187 | | 4/1983 | |
| WO | WO 2003/008695 | | 1/2003 | |
| WO | WO 2004/018143 | | 3/2004 | |
| WO | WO 2004/096006 | | 11/2004 | |
| WO | WO 2005/018407 | | 3/2005 | |
| WO | WO 2013/090443 | | 6/2013 | |

OTHER PUBLICATIONS

Machine translation of DE102005030720A1 dated Jan. 2007 (Year: 2007).*

Patent Abstracts of Japan, vol. 018, No. 634 (C-1281) (Dec. 2, 1994) & JP 06245890 (Yokokawa Denshi Kiki KK) (Sep. 6, 1994).

Patent Abstracts of Japan, vol. 017, No. 164 (M-1390) (Mar. 30, 1993) & JP 04327119 (Mitsubishi Heavy Ind. Ltd.) (Nov. 16, 1992).

PCT, International Search Report and Written Opinion, International Application No. PCT/US2016/033735; dated Aug. 12, 2016, 10 pages.

* cited by examiner

WAREWASH MACHINE CLEANING NOTIFICATION AND IN-SITU DILUTION PROCESS

TECHNICAL FIELD

This application relates generally to commercial warewash machines and, more specifically, to a commercial warewash machine with in-situ tank soil load reduction.

BACKGROUND

Current commercial warewash machines generally require intermittent downtime to drain, clean, and refill after a predetermined duration of operation to prevent poor wash quality, especially due to food soil redeposit, as well as to prolong the life of a machine. For the forgoing reasons, in some machines normal use requires an hour shutdown after every 2 hours of operation in order to drain, clean, refill and warm the machine in preparation for another 2 hours of machine operation.

However, this mode of cleaning is unfavorable given some very busy and high throughput kitchens which have very limited floor space to fit a higher throughput machine to meet the need. In most cases, these busy kitchens with small floor spaces fit smaller throughput machines and cannot afford the luxury of downtime after every 2 hour of operation for machine cleaning. These busy kitchens need machines or machine operations tailored to meet their needs.

Moreover, in some cases warewash machines that are only used intermittently for ware cleaning also follow the requirement of cleaning the machine after every 2 hours of operation. This procedure of cleaning the machine every 2 hours irrespective of the fact of only intermittent use for cleaning wares leads to waste of energy, chemicals, water and unnecessary downtimes in the case of such intermittently used machines.

U.S. Patent Publication No. 2008/0245394 discloses a warewash machine in which a main wash reservoir can be directly filled with clean water via a main cleaning line if great contamination in the main wash reservoir is detected. U.S. Patent Publication No. 2012/0298146 discloses that upon detection of high soiling within a tank of a warewash machine, the rinse flow rate can be increased in order to dilute the soiling. Although these systems are somewhat effective, improvements are continuously sought.

It would be desirable to provide a machine that incorporates machine cleaning notification characteristics and/or machine wash solution characteristics to reduce unnecessary downtime and save on energy, chemicals, and water by providing any improved in-situ dilution of tank water.

SUMMARY

In one aspect, a method is provided for operating a warewash machine that includes at least one collection tank for collecting wash liquid that is recirculated and sprayed for cleaning wares within a spray zone of the machine. The method involves: (1) a machine controller monitoring at least one machine condition; (2) based upon the monitoring in step (1) the machine controller automatically making a determination that machine cleaning is necessary; and (3) in response to the determination in step (2), carrying out in-situ tank soil load reduction for a collection tank without completely draining the machine. The in-situ tank soil load reduction involves at least one of: (i) prior to addition of fresh water, draining the collection tank via a path that exits the collection tank at a location lower than a primary overflow path until wash liquid level in the collection tank drops below a standard operating level, and thereafter adding fresh water through a tank fill line and/or through a final rinse spray path; or (ii) draining the collection tank via a path that exits the collection tank at a location lower than a primary overflow path while simultaneously adding fresh water through a tank fill line and/or through a final rinse spray path; or (iii) adding fresh water through a tank fill line and/or through a final rinse spray path such that wash liquid level in the collection tank rises above a standard operating level, and thereafter carrying out draining of the collection tank. In one example, when the determination is made that machine cleaning is necessary, the controller causes display of an operator alert on a user interface, and the operator thereafter initiates the in-situ dilution via the interface, and thus the operator initiation is in response to the determination. In another example, when the determination is made that machine cleaning is necessary, the controller automatically initiates the in-situ dilution at an appropriate time (e.g., immediately or at some later specified or appropriate time), and thus the controller initiation is in response to the determination.

In another aspect, a warewash machine includes a spray zone for spaying liquid onto wares from a collection tank via a recirculation line and pump, a primary overflow path from the collection tank and at least one drain path from the collection tank that exits the collection tank at a location lower than the primary overflow path. At least a first controllable valve is located for controlling flow along the at least one drain path. A fresh water infeed arrangement comprises a tank fill line and/or a final rinse spray path. A controller is configured to selectively operate the controllable valve and the fresh water infeed arrangement to achieve in-situ soil load reduction of wash liquid in the collection tank without completely draining the machine. The controller is configured to carry out in-situ soil load reduction by at least one of: (i) prior to operating the fresh water feed arrangement for addition of fresh water, opening the first controllable valve to drain the collection tank via the drain path until wash liquid level in the collection tank drops below a standard operating level, and thereafter closing the first controllable valve and operating the fresh water feed arrangement to add fresh water; or (ii) opening the first controllable valve to drain the collection tank via the drain path while simultaneously operating the fresh water feed arrangement to add fresh water; or (iii) operating the fresh water feed arrangement to add fresh water while the first controllable valve is closed such that wash liquid level in the collection tank rises above a standard operating level, and thereafter opening the first controllable valve to carry out draining of the collection tank.

In a further aspect, a warewash machine includes a spray zone for spaying liquid onto wares from a collection tank via a recirculation line and pump, a primary overflow path from the collection tank, an intermediate drain path from the collection tank that exits the collection tank at a location lower than the primary overflow path and above a bottom of the collection tank, and a primary drain path that exits the collection tank at the bottom of the collection tank. In one implementation, a first controllable valve is positioned to control flow along the intermediate drain path without affecting flow along the primary overflow path or the primary drain path, and a second controllable valve is positioned to control flow along each of the intermediate drain path, the primary overflow path and the primary drain path.

The details of one or more embodiments are set forth in the accompanying drawings and the description below. Other features, objects, and advantages will be apparent from the description and drawings, and from the claims.

DETAILED DESCRIPTION

A warewash machine is configured to reduce machine downtime or unnecessary downtime for cleaning by providing notifications of characteristics or conditions of the machines and/or of tank (s) fluid to initiate in-situ tank(s) soil load reduction by diluting with fresh water at predetermined values of total fill and/or rinse on-time, the number of cycles/racks cleaned, gallons of water processed, wash solution turbidity (or any combination of the foregoing) while the machine is still in operation. As used herein, the term "machine condition" encompasses any characteristic or condition within a machine or relating to machine operation, including total machine water fill, rinsing on time or volume, number of cleaning cycles or number of racks cleaned, volume of water processed, soiling of wash liquid and/or wash liquid concentration.

The in-situ dilution, flagged or triggered by monitoring of one or more machine conditions, can be achieved by any of the following processes: (i) drain the tank(s) to an acceptable non-empty level followed by fresh water addition through fill lines(s) and valve(s) and/or through sprays from the final rinse arms; (ii) drain the tank(s) simultaneous with dilution by fresh water addition through fill lines(s) and valve(s) and/or through the sprays from final rinse arms; or (iii) dilute the tank(s) by allowing fresh water addition through fill line(s) and valve(s) and/or through sprays from the final rinse arms while liquid level in the tank rises by initially preventing both overflow and other draining.

The in-situ soil load reduction concepts apply to door or conveyor (rack or flight) type machines having a single or multiple tanks for recirculating wash liquid sprays. The above operation(s) can be carried out simultaneously while the machine is in operation to enhance low throughput machines (by reducing the need for shut down) to meet busy kitchens need given the tight floor space. This will prevent or reduce downtimes of the machine for cleaning. Two primary processes, namely automatic and manual draining and diluting systems, are proposed.

Figure 1:
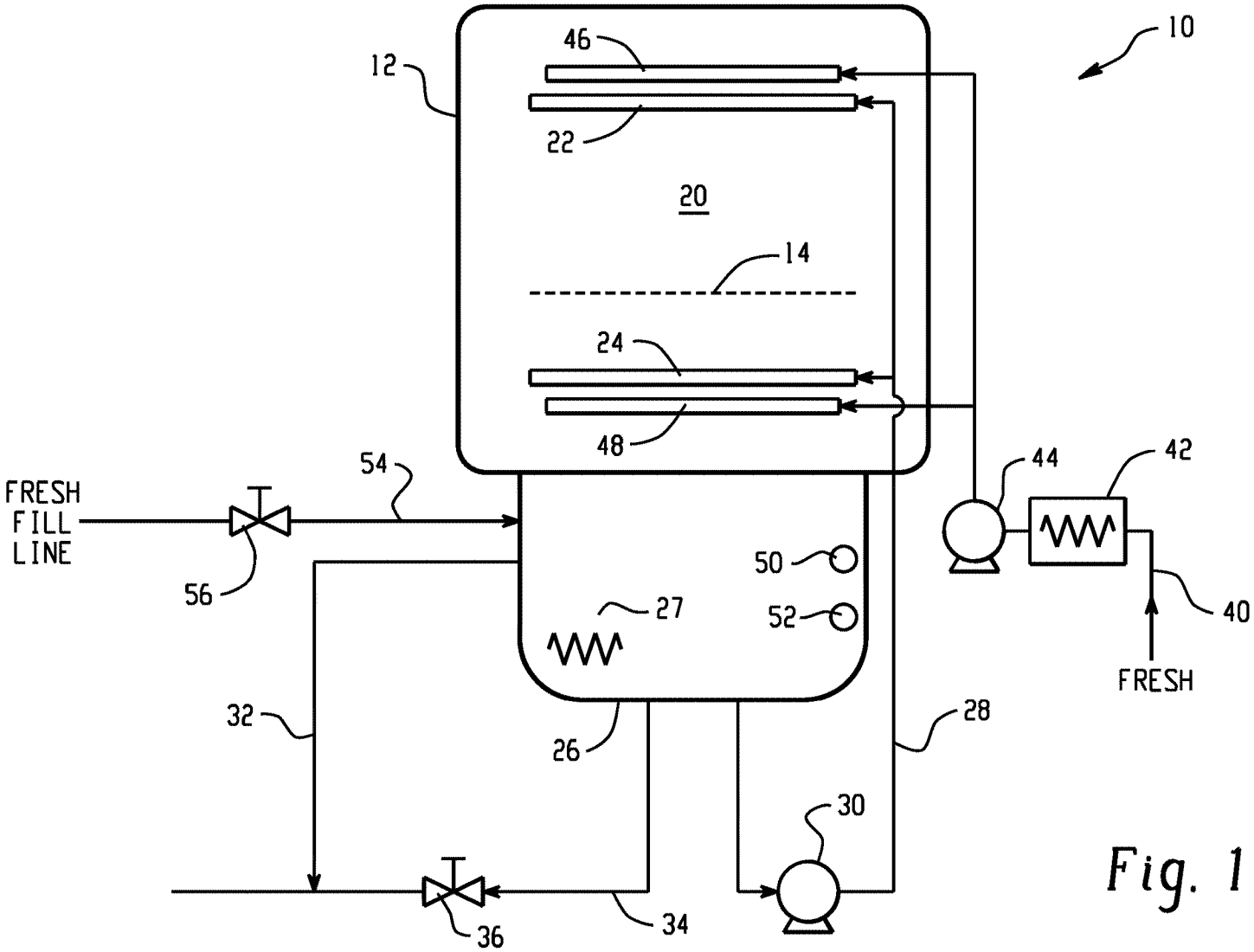
FIG. 1 is a schematic depiction of one embodiment of a warewash machine.

Referring to FIG. 1, a schematic view of an exemplary warewash machine 10 is shown. The machine includes a housing 12 defining a space for receiving wares to be cleaned. In the case of a box-type or door machine wares may be moved into and out of the space manually. In the case of a conveyance-type machine the housing may form a tunnel through which the wares are delivered by a conveyance mechanism 14 (ware movement would be in or out of the page in this view in the case of a conveyance-type machine). An exemplary spray zone 20 of the machine includes one or more upper spray arms 22 and/or one or more lower spray arms 24, it being recognized that in some cases a spray zone may, in addition or as an alternative, include one or more side spray arms (not shown) as well. A wash liquid recirculation system includes a liquid collection tank 26 with a heating element 27, a recirculation line 28 back to the spray arms 22, 24 and a pump 30 for moving the wash liquid along the path. An overflow path 32 to drain is also provided from the tank. Path 32 may be direct to drain, or may be a path that passes through one or more additional tanks of other spray zones before flowing to drain. A primary drain line 34 extends from the bottom of the tank 26 to enable complete draining, and includes a valve 36 therealong. Valve 36 is primarily contemplated as a manual valve. A final rinse system of the machine 10, which in the case of a conveyance-type machine may be downstream of the spray zone 20, includes a fresh water input line 40, booster heater 42 and pump 44, where pump 44 may be constant speed or variable speed. Operation of the pump 44 delivers fresh water to upper and lower final rinse spray arms 46 and 48. The tank 26 also includes high and low wash liquid level sensors 50 and 52.

For the machine 10 of FIG. 1, overflow from the tank 26 via line 32 is enabled at all times in the normal machine operation. On in-situ dilution activation, fresh water is added by turning on the final rinse (e.g., by operating the pump 44) and/or enabling flow along a tank fill line 54 by opening a valve 56 to displace dirty water from the tanks(s) using fresh water addition. In one implementation, where valve 36 is an automatically controllable valve, the tank 26 may be partially drained to a specified non-empty level before the addition of the fresh water for dilution, thereby assuring that the most soiled liquid is expelled before adding fresh water.

In the case of a conveyance-type machine of FIG. 1, the subject tank 26 could be any of a wash tank, power rinse or post-wash tank, and/or a prewash tank where dilution of soil contaminants is desired.

Figure 2:
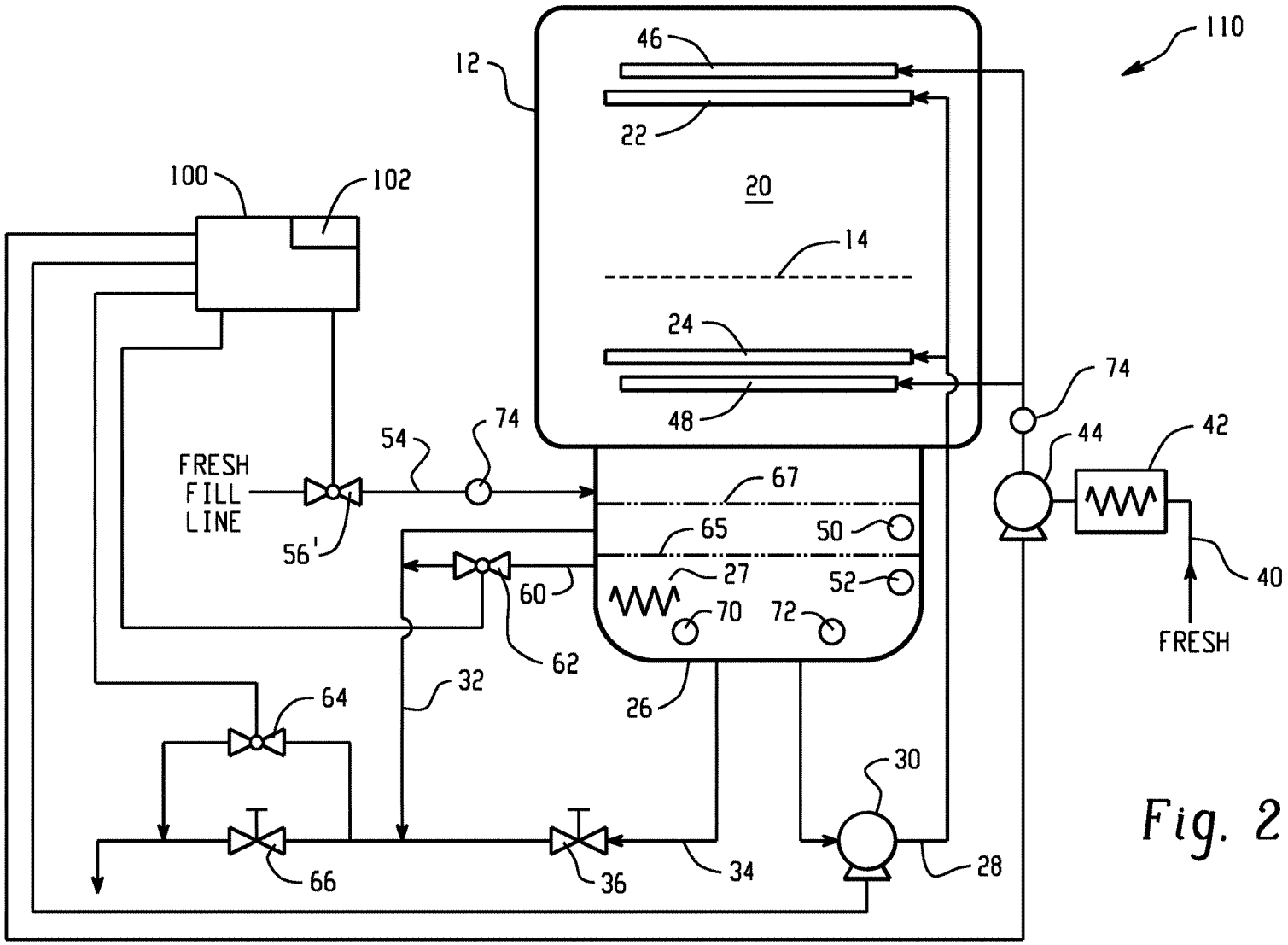
FIG. 2 is a schematic depiction of another embodiment of a warewash machine.

Referring now to FIG. 2, a schematic view of another exemplary warewash machine 110 is shown, where like numbers as between FIGS. 2 and 1 refer to similar components. The machine 100 of FIG. 2 is more automated, enabling more advantageous operation for purpose of the in-situ dilution operation. The machine 110 includes an intermediate drain path 60 from the collection tank 26 that exits the tank lower than the primary overflow path 32 and above a bottom of the collection tank where the main drain line 34 exits. A controllable valve 62 is located along the intermediate drain path 60 to enable selective control of draining along the path. A controllable valve 56' selectively enables flow along fresh fill line 54, and an automated valve 64 and manual valve 66 are located in parallel downstream of the both controllable valve 62 and manual valve 36.

A machine controller 100 is connected for controlling operation of each of the pumps 30 and 44, and the valves 56', 62 and 64. As used herein, the term controller is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof. The controller 100 may include an associated user interface 102 (e.g., at which a need to clean alert/notification may be displayed or a cleaning in process alert/notification may be displayed, and through which a user may trigger or initiate machine operations, such as in-situ dilution). The controller may include additional connections to other machine components, such as a tank turbidity sensor(s) 70, temperature sensor(s) 72, flow volume sensor(s) 74 etc. For example, turbidity sensor 70 could take the form of an ultrasonic sensor used to measure solution soil load or concentration in order to trigger an in-situ dilution operation.

In one example of a triggered in-situ dilution process in the machine 110, the manual drain valve 36 is maintained closed while the automatic valve 62 is opened and closed before and after dilution, respectively. In particular, assuming manual drain valve 66 is open and/or automated or controllable drain valve 64 is opened by the controller, prior to addition of fresh water, the collection tank is drained via path 60 until wash liquid level in the collection tank 26 drops below a standard operating level (generally defined as the level of the overflow path 32) by the controller opening the valve 62. The controller 100 thereafter implements addition of fresh water through the tank fill line 54 by opening valve 56' and/or through the final rinse spray path by turning on the pump 44. The controllable valve 62 may be maintained open until wash liquid level in the collection tank drops to a specified non-empty level 65 and the valve 62 is then automatically closed. In some cases the addition of fresh water begins only after the wash liquid level in the collection tank drops to the specified non-empty level (e.g., as indicated by a sensor or as indicated by a timed duration of opening of the valve 62). In a machine that lacks intermediate drain path 60, it is contemplated that the partial drain for the purpose of dilution can be implemented via the main drain line 34 if valve 36 is an automated valve. Partial draining of the tank(s) before adding fresh water for dilution helps ensure more effective removal of dirty or soiled water, hence saving more energy, chemicals and water and reduce machine downtime for some flight, conveyor and box type machines.

In another example of a triggered in-situ dilution process for the machine 110 of FIG. 2, the manual drain valve 36 is closed and the drain valve 62 is opened while fresh water is added to the tank (e.g., by opening valve 56' and/or turning on the pump 44). Manual drain valve 66 is open and/or automated or controllable drain valve 64 is also opened by the controller. In this case, the lower drain point provided by intermediate drain path 60 assures that the water drained is at least somewhat removed from the upper location of fresh water being added in order to be more likely to drain more soiled wash liquid as opposed to freshly added water. In one implementation, a volumetric inflow rate of fresh water is set or controlled to be lower than a volumetric outflow rate of draining wash liquid (e.g., such that the liquid level in the tank initially drops as fresh water is added) and the valve 62 is closed before addition of fresh water is stopped. In a machine that lacks intermediate drain path 60, it is contemplated that the drain simultaneous with fresh water addition during dilution can be implemented via the main drain line 34 if valve 36 is an automated valve.

In yet another example of a triggered in-situ dilution process for the machine 110 of FIG. 2, the manual drain valve 36 is closed, the drain valve 62 is closed, and the drain valve 64 is also closed so that no draining or overflow can occur, and fresh water is added through the tank fill line and/or through the final rinse spray path (e.g., by opening valve 56' and/or turning on the pump 44) such that wash liquid level in the collection tank 26 rises above the standard operating level. Thereafter, a partial draining of the collection tank is carried out. The controller 100 may implement the fresh water add until the wash liquid level in the collection tank reaches a specified overfill level 67 or for a specified period of time, before opening valve 64 (and in some cases valve 62) for the partial drain. In some machines the steps may be repeated for a number of sequences (e.g., fresh water fill above normal level, followed by drain to normal level, followed by fresh water fill above normal level, followed by drain to normal level etc.).

The automatic system has the flexibility to perform any of the following dilution operations: (i) drain the tank(s) to an acceptable level followed by fresh water addition through fill lines(s) and valve(s) and/or through sprays from the final rinse arms; (ii) drain the tank(s) simultaneous with dilution by fresh water addition through fill line(s) and valve(s) and/or through the sprays from final rinse arms; or (iii) dilute the tank (s) by allowing fresh water addition through fill line(s) and valve(s) and/or through sprays from the final rinse arms without any overflow or draining until the tank level rises.

In summary, in-situ dilution may be initiated according to predetermined values of various monitored machine conditions, such as any of the number of cycles/racks; gallons of water processed, total fill & rinse on-time, wash solution turbidity, wash solution concentration, or combinations of the foregoing. The in-situ dilution techniques apply to single tank machines and or multiple tank machines. The more automated system has additional advantages of draining a single or multiple tanks simultaneously while diluting or diluting after draining tank(s) to acceptable level(s). Systems may have variable fresh water rates to control the dilution process time(s) while not dropping the tank(s) temperatures below specified requirements that would prompt excessive energy consumption. A machine already in the fill and/or rinse mode when the dilution process is triggered may extend the fill and/or rinse time a particular rate to fulfil the demands of the dilution process.

The in-situ dilution operations can reduce tank(s) food soil load while the machine is in operation with/without operator knowledge by draining tank(s) to acceptable level(s) and then diluting tank(s) with fresh water. Reduction of tank(s) food soil load while the machine is in operation with/without operator knowledge by simultaneous tank(s) draining and diluting tank(s) with fresh water for a predetermined time is also possible. The use of an intermediate drain path facilitates removal of hot dirty tank(s) fluid while protecting pump and heating elements from running dry. Varying the dilution rate or varying the dilution time is also possible. Balance the dilution rate to maintain machine temperature requirements while the machine is still in operation can also be achieved. Adjustment of trigger conditions such as number of cycles/racks, total gallons of water processed, and total fill & rinse-on-time, turbidity wash solution concentration or combinations is possible at any given customer site to meet the need.

Possible advantages of the in-situ dilution processes are many. Savings on chemical, water, and energy with reduced machine downtime are enabled. Keeping machine uptime high for customers is desirable. The ability to monitor various machine operations to tailor machines to meet customers' needs is provided. Increased machine reliability by maintaining the correct operational chemistry in the wash is also advantageous.

It is to be clearly understood that the above description is intended by way of illustration and example only, is not intended to be taken by way of limitation, and that other changes and modifications are possible.

What is claimed is:

1. A method of operating a warewash machine that includes at least one collection tank for collecting wash liquid that is recirculated and sprayed for cleaning wares within a spray zone of the machine, the method comprising:

(a) carrying out an in-situ tank operation by adding fresh water to the collection tank through a tank fill line such that wash liquid level in the collection tank rises above a standard wash liquid operating level of the collection tank, and thereafter carrying out partial draining of the collection tank, wherein the collection tank includes both a drain path and an overflow path, where the overflow path exits the collection tank at an exit location above an exit location of the drain path, wherein a first controllable valve is located along the overflow path, and the tank fill line includes a second controllable valve located therealong, and step (a) involves a machine controller automatically closing the first controllable valve and thereafter opening the second controllable valve to add fresh water to the collection tank through the collection tank fill line either (i) until the wash liquid level in the collection tank reaches a specified overfill level or (ii) for a specified period of time, and in either case (i) or case (ii), thereafter closing the second controllable valve and opening the first controllable valve to carry out the partial draining at least in part by overflow along the overflow path;

further comprising:

(1) the machine controller monitoring at least one machine condition;

(2) based upon the monitoring in step (1) the machine controller automatically making a determination that machine cleaning is necessary; and in response to the determination in step (2) the machine controller automatically carrying out the in-situ tank operation of step (a).

2. The method of claim 1 wherein the process of step (a) is repeated two or more times sequentially.

3. The method of claim 1 wherein the machine condition is one or more of (i) total machine water fill, (ii) rinsing on time or volume, (iii) number of cleaning cycles or number of racks cleaned, (iv) volume of water processed, (v) soiling of wash liquid or (vi) any combination of (i), (ii), (iii), (iv) and/or (v).

4. A method of operating a warewash machine that includes at least one collection tank for collecting wash liquid that is recirculated and sprayed for cleaning wares within a spray zone of the machine, the method comprising:

(1) a machine controller monitoring at least one machine condition;

(2) based upon the monitoring in step (1) the machine controller automatically making a determination that machine cleaning is necessary; and (3) in response to the determination in step (2), carrying out in-situ tank soil load reduction for a collection tank without completely draining the machine, wherein the in-situ tank soil load reduction involves adding fresh water through a tank fill line and/or through a final rinse spray path such that wash liquid level in the collection tank rises above a standard operating level, and thereafter carrying out partial draining of the collection tank, wherein the collection tank includes both a drain path and a primary overflow path, where the overflow path exits the collection tank at an exit location above an exit location of the drain path, wherein step (3) involves automatically closing a first controllable valve that controls flow along the primary overflow path, and adding fresh water through the collection tank fill line and/or through the final rinse spray path so that wash liquid level in the collection tank rises above the exit location of the primary overflow path, and thereafter opening the first controllable valve to carry out the partial draining at least in part by overflow along the primary overflow path.

5. The method of claim 4 wherein the process of step (3) is repeated two or more times sequentially.

6. The method of claim 4 wherein the machine condition is one or more of (i) total machine water fill, (ii) rinsing on time or volume, (iii) number of cleaning cycles or number of racks cleaned, (iv) volume of water processed, (v) soiling of wash liquid or (vi) any combination of (i), (ii), (iii), (iv) and/or (v).

7. A method of operating a warewash machine that includes at least one collection tank for collecting wash liquid that is recirculated and sprayed for cleaning wares within a spray zone of the machine, the method comprising:

(1) a machine controller monitoring at least one machine condition;

(2) based upon the monitoring in step (1) the machine controller automatically making a determination that machine cleaning is necessary; and (3) in response to the determination in step (2), carrying out in-situ tank soil load reduction for a collection tank without completely draining the machine, wherein the in-situ tank soil load reduction involves adding fresh water through a tank fill line and/or through a final rinse spray path such that wash liquid level in the collection tank rises above a standard operating level, and thereafter carrying out partial draining of the collection tank, wherein the collection tank includes a primary drain path, a primary overflow path and an intermediate drain path, wherein the intermediate drain path exits the collection tank at an exit location above an exit location of the primary drain path and below an exit location of the primary overflow path, wherein the primary overflow path includes a first controllable valve therealong and the intermediate drain path includes a second controllable valve therealong, and a machine controller maintains the first controllable valve in a closed condition and the second controllable valve in a closed condition during the adding of fresh water so that no overflow can occur during the adding of fresh water, and the partial draining involves opening one or both of the first controllable valve or the second controllable valve.

* * * * *